US008897420B1

(12) United States Patent
Hunt et al.

(10) Patent No.: US 8,897,420 B1
(45) Date of Patent: Nov. 25, 2014

(54) ANTI-FRETTING COATING FOR ROTOR ATTACHMENT JOINT AND METHOD OF MAKING SAME

(75) Inventors: Ian Strider Hunt, Sussex, WI (US); Andrew Thomas Triscari, Hubertus, WI (US)

(73) Assignee: General Electric Company, Schenectady, NY (US)

( * ) Notice: Subject to any disclaimer, the term of this patent is extended or adjusted under 35 U.S.C. 154(b) by 382 days.

(21) Appl. No.: 13/367,414

(22) Filed: Feb. 7, 2012

(51) Int. Cl.
*H01J 35/10* (2006.01)
*H01J 35/26* (2006.01)
*H01J 35/24* (2006.01)

(52) U.S. Cl.
CPC ..... *H01J 35/101* (2013.01); *H01J 35/26* (2013.01); *H01J 35/24* (2013.01); *H01J 2235/102* (2013.01); *H01J 2235/1006* (2013.01); *H01J 2235/1046* (2013.01); *H01J 2235/1053* (2013.01)
USPC ..... 378/132; 378/125; 378/144

(58) Field of Classification Search
CPC . H01J 35/101; H01J 35/26; H01J 2235/1006; H01J 2235/102; H01J 2235/1046; H01J 2235/1053; H01J 35/24
USPC ..... 378/125, 132, 144
See application file for complete search history.

(56) References Cited

U.S. PATENT DOCUMENTS 4,914,684 A 4/1990 Upadhya
5,548,628 A 8/1996 Eggleston et al.
5,655,000 A 8/1997 Benz et al.
5,673,301 A 9/1997 Tekriwal
5,838,762 A * 11/1998 Ganin et al. ..... 378/125
5,875,227 A 2/1999 Bhatt
6,064,719 A * 5/2000 Vetter et al. ..... 378/132
6,203,895 B1 3/2001 Berger et al.
6,480,571 B1 * 11/2002 Andrews ..... 378/131
6,553,097 B2 4/2003 Hansen et al.
6,735,281 B2 * 5/2004 Higgins et al. ..... 378/132
7,184,520 B1 * 2/2007 Sano ..... 378/125
7,343,002 B1 * 3/2008 Lee et al. ..... 378/132
7,397,897 B2 * 7/2008 Anand et al. ..... 378/132
7,492,869 B1 * 2/2009 Qiu et al. ..... 378/132
7,492,870 B2 2/2009 Peterson, II et al.
7,505,564 B2 3/2009 Anand et al.
7,643,614 B2 * 1/2010 Hebert et al. ..... 378/129
7,672,433 B2 * 3/2010 Zhong et al. ..... 378/129
7,796,737 B2 * 9/2010 Allen et al. ..... 378/140
7,991,121 B2 * 8/2011 Smith ..... 378/132
7,995,708 B2 * 8/2011 Andrews et al. ..... 378/131
8,300,770 B2 * 10/2012 Coon et al. ..... 378/141
8,542,799 B1 * 9/2013 Rogers et al. ..... 378/125

FOREIGN PATENT DOCUMENTS

EP 1818552 A1 8/2007
JP 1163948 A2 6/1989

* cited by examiner

*Primary Examiner* — Allen C. Ho
(74) *Attorney, Agent, or Firm* — Ziolkowski Patent Solutions Group, SC

(57) ABSTRACT

An x-ray tube includes a cathode adapted to emit electrons, a bearing assembly comprising a rotatable shaft having a rotor hub, a target assembly attached to the rotatable shaft and positioned to receive the emitted electrons in order to generate x-rays therefrom, a rotor attached to the rotor hub at an attachment face, wherein the attachment face comprises a first material compressed against a second material, and a first anti-wear coating attached to one of the first material and the second material and positioned between the first material and the second material.

19 Claims, 3 Drawing Sheets

ANTI-FRETTING COATING FOR ROTOR ATTACHMENT JOINT AND METHOD OF MAKING SAME

BACKGROUND OF THE INVENTION

Embodiments of the invention relate generally to x-ray tubes and, more particularly, to an anti-fretting coating for a rotor attachment joint and a method of making same.

Computed tomography x-ray imaging systems typically include an x-ray tube, a detector, and a gantry assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector converts the received radiation to electrical signals and then transmits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

A typical x-ray tube includes a cathode that provides a focused high energy electron beam that is accelerated across a cathode-to-anode vacuum gap and produces x-rays upon impact with an active material or target provided. Because of the high temperatures generated when the electron beam strikes the target, typically the target assembly is rotated at high rotational speed for purposes of spreading the heat flux over a larger extended area. The target is attached to a support shaft, which is in turn supported by roller bearings that are typically hard mounted to a base plate.

As such, the x-ray tube also includes a rotating system that rotates the target for the purpose of distributing the heat generated at a focal spot on the target. The rotating subsystem is typically rotated by an induction motor having a cylindrical rotor built into an axle that supports a disc-shaped target and an iron stator structure with copper windings that surrounds an elongated neck of the x-ray tube. The rotor of the rotating subsystem assembly is driven by the stator.

During manufacturing, the rotor may be attached to the axle of the rotating subsystem using for instance a weld or a bolted joint. In the case of a welded attachment an adequate joint for joining the rotor to the axle can typically be formed using common and known welding techniques. However, welded joints can be costly, both in terms of the manufacturing process but also in terms of inspection and rework costs. The costs of a weld joint for the rotor are also compounded because often the welding is performed in a clean environment, necessitating special care to maintain cleanliness and to reduce particulate emission.

In the case of a bolted joint, fabrication and assembly costs can be significantly reduced overall when compared to a welded joint. However, such bolted joints are subject to wear and early life failure for a number of reasons. First off, relative motion can occur between components, due at least in part to a mismatch of thermal expansion coefficients of the materials that are typically on either side of the bolted joint. As the parts heat up during x-ray tube operation, the thermal coefficient mismatch causes a mismatch in the amount of expansion of the components, enabling the components to slide relative to each other. This manifests itself in the form, typically, of radially oriented fretting that occurs at the face of the materials that make up the bolted joint.

Secondly, the cyclical nature of the joint loading can cause relative motion in the joints as well. Because the target is typically rotated about its axis at a high rate of speed, typically 100 Hz or more, and because the x-ray tube itself is rotated at a high rate of speed on a gantry, typically 2 Hz or more, enormous periodic or cyclical loads can be generated at interfaces that join the rotor to the bearing axle or shaft. So, high-frequency periodic loads are applied to the joint due to the target rotation and some unavoidable residual unbalance of the rotating components and low-frequency periodic loads due to the tube rotation on the CT gantry. Such loads can cause bending of the rotor joint components causing small relative circumferential motion to occur, which can cause circumferentially oriented fretting that occurs at the face of the materials that make up the bolted joint.

In order to reduce the amount of fretting that occurs in the bolted joint, parts may be pressfit together as well in order augment the pressure between components. Thus, an interference fit may be formed that couples or otherwise attaches the rotor to the bearing shaft, which are then bolted together as well. However, despite having an improved joint, fretting and particulate generation can nevertheless occur therein. In fact, particles can be generated at any interface where materials are in a bolted joint or in an interference fit pressed together. And, the effect can increase significantly with increased gantry and/or increased target rotating speed, leading to increased fretting and particulate generation as x-ray tubes are rotated faster on gantries and as targets are rotated faster within x-ray tubes.

As known in the art, particulate in an x-ray tube can degrade performance and life in a number of ways that include, for instance, accelerated bearing wear if the wear particles fall into the bearing and electrical discharge activity in the high voltage environment of the x-ray tube. Both of these issues reduce the useful life of the x-ray tube.

Accordingly, it would be advantageous to have an x-ray tube that could be rotated at a high speed on a gantry and at a high target rotational speed without a reduction in life due to particulate generation at connection joints in the x-ray tube.

BRIEF DESCRIPTION OF THE INVENTION

Embodiments of the invention provide an apparatus and method of attaching a rotor to a bearing having a reduced amount of particulate generation at interfaces of attachment locations thereof.

According to one aspect of the invention, an x-ray tube includes a cathode adapted to emit electrons, a bearing assembly comprising a rotatable shaft having a rotor hub, a target assembly attached to the rotatable shaft and positioned to receive the emitted electrons in order to generate x-rays therefrom, a rotor attached to the rotor hub at an attachment face, wherein the attachment face comprises a first material compressed against a second material, and a first anti-wear coating attached to one of the first material and the second material and positioned between the first material and the second material.

In accordance with another aspect of the invention, a method of fabricating an anode assembly for an x-ray tube includes applying a first anti-wear coating to one of a first material and a second material, and attaching a rotor to a rotatable bearing shaft at an interface that is comprised of the first material and the second material, wherein the rotor comprises the first material and the rotatable bearing shaft comprises the second material.

Yet another aspect of the invention includes an x-ray imaging system that includes a gantry, a detector attached to the gantry, and an x-ray tube attached to the gantry, the x-ray tube includes a bearing assembly having a rotatable bearing shaft and a rotor hub attached thereto, an x-ray target attached to a first end of the rotatable bearing shaft, a rotor attached to a second end of the rotatable bearing shaft at a contact location, and a first anti-fretting coating, wherein the contact location comprises a first material attached to a second material, and wherein the first anti-fretting coating is attached to one of the first material and the second material at the contact location and is positioned between the first material and the second material.

Various other features and advantages of the invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION

Figure 1:
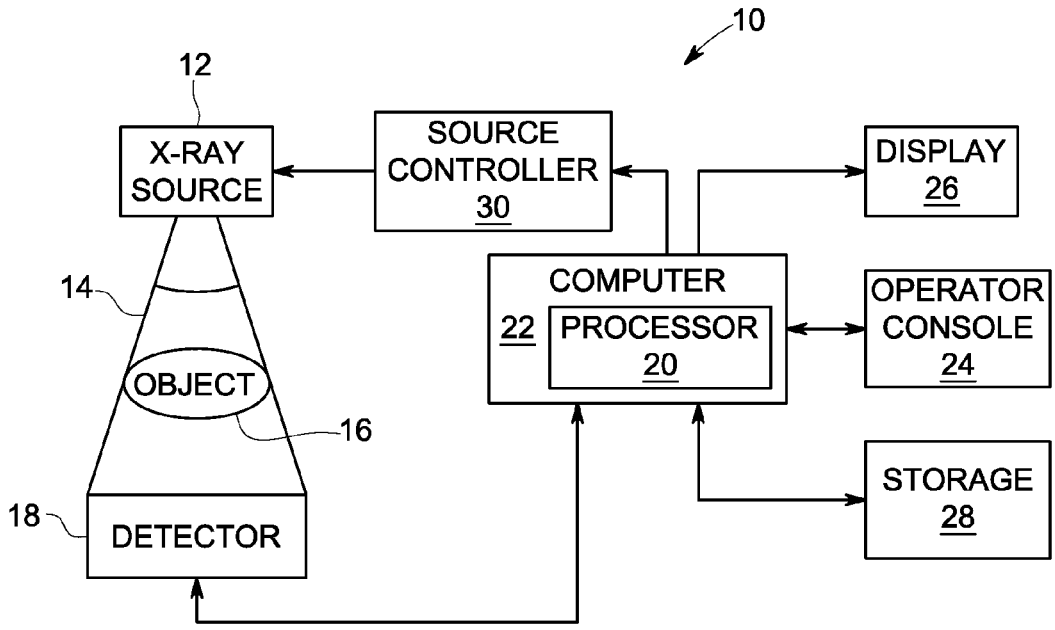
FIG. 1 is a block diagram of an imaging system that can benefit from incorporation of an embodiment of the invention.

FIG. 1 is a block diagram of an embodiment of an x ray system 10 designed both to acquire original image data and to process the image data for display and/or analysis in accordance with the invention. It will be appreciated by those skilled in the art that the invention is applicable to numerous medical imaging systems implementing an x-ray tube, such as x-ray or mammography systems. Other imaging systems such as computed tomography (CT) systems and digital radiography (RAD) systems also benefit from the invention. In a CT system, for instance, x-ray source 12 and detector 18 may be mounted on a gantry (not shown) and rotated about object 16 at a high rate of speed of, for instance, 2 Hz or greater. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, operator console 24 allows an operator to store the generated image in a storage device 28 which may include hard drives, flash memory, compact discs, etc. The operator may also use operator console 24 to provide commands and instructions to computer 22 for controlling a source controller 30 that provides power and timing signals to x-ray source 12.

Figure 2:
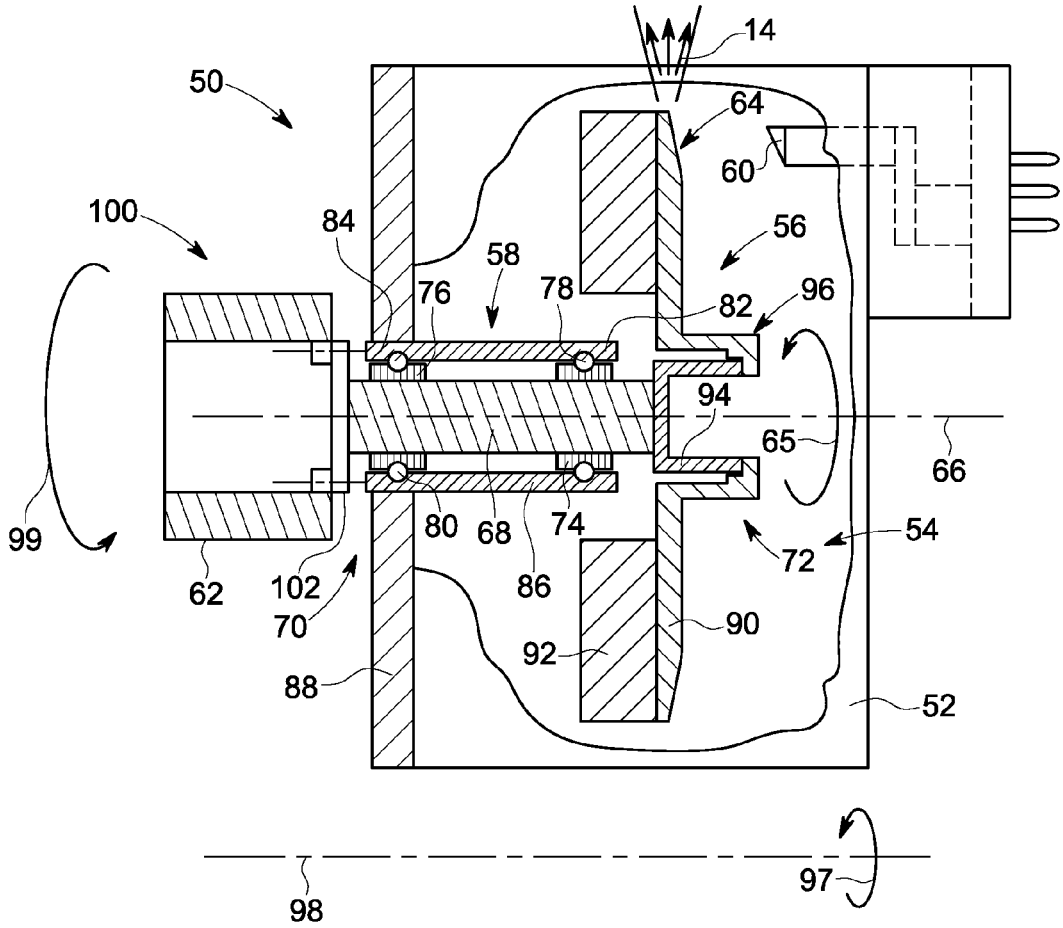
FIG. 2 is a cutaway view of an x-ray tube or source incorporating embodiments of the invention.

FIG. 2 illustrates a cutaway portion of an x-ray source or tube 50 constructed in accordance with the invention. X-ray source or tube 50 may be used in any system using x-rays for imaging, and in one example is x-ray source 12 of FIG. 1. X-ray source or tube 50 includes a frame or casing 52 that encloses a vacuum 54 and houses an anode or target assembly 56, a bearing assembly 58, a cathode 60, and a rotor 62. X-rays 14 are produced when high-speed electrons are suddenly decelerated when directed from cathode 60 to anode or target assembly 56, and particularly to a focal spot 64 via a potential difference therebetween of, for example, 60 thousand volts or more. The electrons impact focal spot 64 and x-rays 14 emit therefrom toward a detector, such as detector 18 illustrated in FIG. 1. To avoid overheating anode or target assembly 56 from the electrons, anode or target assembly 56 is rotated 65 at a high rate of speed about a centerline 66 at, for example, 20-250 Hz.

Bearing assembly 58 includes a center shaft 68 attached to rotor 62 at a first end 70 and attached to anode or target assembly 56 at a second end 72. A front inner race 74 and a rear inner race 76 rollingly engage a plurality of front balls 78 and a plurality of rear balls 80, respectively. Bearing assembly 58 also includes a front outer race 82 and a rear outer race 84 configured to rollingly engage and position, respectively, the plurality of front balls 78 and the plurality of rear balls 80. Bearing assembly 58 includes a stem 86 which is supported by a backplate 88 of x-ray tube 50. A stator (not shown) is positioned radially external to and drives rotor 62, which rotationally drives anode or target assembly 56. Anode or target assembly 56 includes a target 90 having a heat sink material 92 such as graphite attached thereto. Target 90 is attached to a bearing hub 94 at an attachment location or contact region 96. A rotor/bearing attachment assembly 100 is included that includes center shaft 68, and a rotor hub 102 to which rotor 62 is attached.

Figure 3:
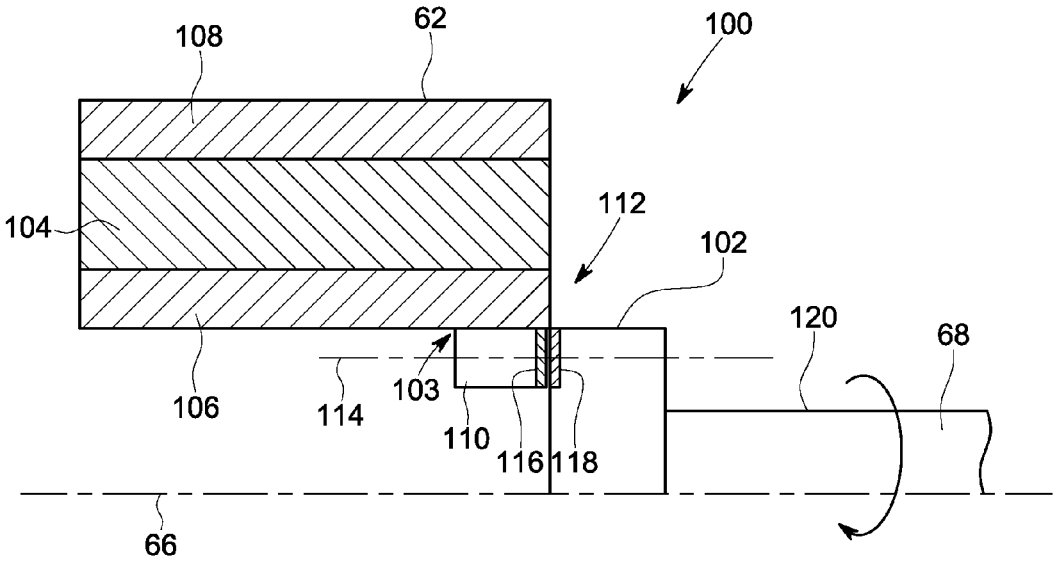
FIG. 3 is a rotor/bearing attachment assembly according to an embodiment of the invention.
Figure 4:
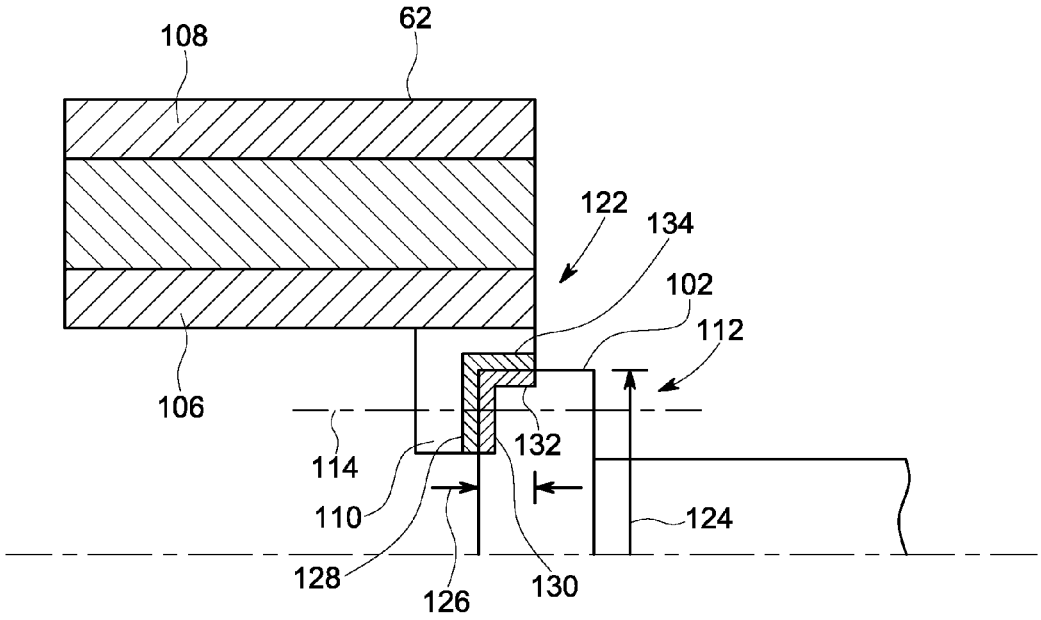
FIG. 4 is a rotor/bearing attachment assembly according to an embodiment of the invention.
Figure 5:
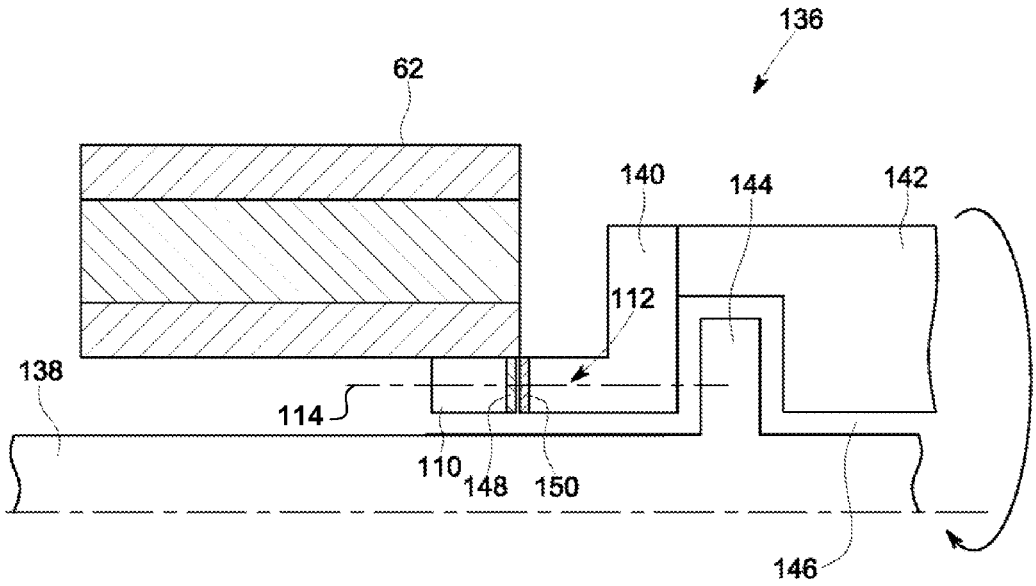
FIG. 5 is a rotor/bearing attachment assembly according to an embodiment of the invention.

Rotor/bearing attachment assembly 100 includes rotor 62 that is attached to rotor hub 102 according to a number of embodiments, as will be further illustrated in FIGS. 3-5. However, it is to be understood that the invention is not to be so limited, and that the invention is applicable to any rotor attached to a rotatable bearing shaft wherein relative motion may occur between contacting components in which particulate generation may occur. It is to be further understood that the invention is applicable to any bearing design, such as an inner rotation bearing (as illustrated for instance in FIGS. 2, 3, and 4), an outer rotation bearing (as illustrated for instance in FIG. 5), all of which may include roller bearings such as illustrated in FIG. 2 or a spiral groove bearing (SGB) (not shown).

Referring now to FIG. 3, rotor/bearing attachment assembly 100 includes rotor 62 illustrated as attached to rotor hub 102, itself attached to center shaft 68. Rotor hub 102 is attached to center shaft 68, in the illustrated embodiment, via a weld joint 103. However, it is equally contemplated that rotor hub 102 is attached to center shaft 68 via a bolted joint wherein a bolt is inserted through rotor hub 102 and into center shaft 68, as understood in the art. The embodiment of FIG. 3 corresponds to and is an exploded view of rotor/bearing attachment assembly 100 of FIG. 2. Typically, rotor 62 includes a copper core 104 positioned between inner ferromagnetic material 106 and outer ferromagnetic material 108 that may comprise, for instance, a carbon-based steel such as 1018 Steel. Rotor 62 is attached to rotor hub 102 via, in this embodiment, an attachment lip 110. Attachment lip 110 is attached to rotor hub 102 via a bolted joint 112 (bolt not illustrated, but the bolt is passed through holes in both attachment lip 110 and rotor hub 102 along a centerline 114, as commonly understood in the art).

Typically, rotor hub 102 is fabricated from a high-temperature metal such as molybdenum, which has a typical expansion coefficient of approximately 5E-6/m-° C. Carbon-based steels such as 1018 Steel has a typical expansion coefficient of approximately 8E-6/m-° C. or greater. Accordingly, due to the mismatch of thermal expansion coefficients between inner ferromagnetic material 106 and rotor hub 102, according to one embodiment attachment lip 110 is fabricated of a material having an expansion coefficient between those of inner ferromagnetic material 106 and rotor hub 102. In one embodiment attachment lip 110 is Incoloy 909® (Incoloy is a registered trademark of Inco Alloys International, Inc. of Delaware),) having an expansion coefficient of approximately 7E-6/m-° C. As such, materials may be used that step the coefficient of expansion incrementally in order to minimize the relative expansion coefficients and reduce the amount of particulate generation that may occur in bolted joint 112. However, in another embodiment, attachment lip 110 is also made of the same material as inner ferromagnetic material 106 (in this example, 1018 Steel), which may preclude the necessity to attach attachment lip 110 to inner ferromagnetic material 106 in a separate attachment step.

Regardless, a mis-match of expansion coeficients typically occurs in the materials that are used to form bolted joint 112. Further, as known in the art, referring back to FIG. 2, x-ray source or tube 50 may be positioned on a gantry (not shown) and caused to rotate 97 about a gantry rotational axis 98. Thus in operation, at least two factors can combine to cause relative part motion and fretting in an x-ray source or tube 50. First, as anode or target assembly 56 (and rotor 62) is caused to rotate about centerline 66 at a high rate of speed, such as 100 Hz or greater, a high frequency input is thus imparted on components. Second, by rotating 97 X-ray source or tube 50 about gantry rotational axis 98 at typically 2 Hz or greater, a bending moment 99 is imposed on components of rotor 62. As such, relative motion occurs at attachment locations due to the high frequency input of 100 Hz or more, which is exacerbated when compounded with the low frequency component of 2 Hz or greater that is caused by bending moment 99. As such, as gantry rotational speeds increase above 2 Hz, the effect of wear and fretting of components is compounded. As such, as parts heat and cool, and are subjected to dynamic loading as described, the contact parts can bond locally particulate generation from shear resulting therefrom, causing wear, fretting, and ultimately particulate generation which can lead to early life failure.

As such, according to embodiments of the invention, materials that are used to form contact locations, such as the materials that are used to form bolted joint 112, may have formed or positioned thereon anti-fretting materials to reduce or eliminate particulate generation. Referring back to FIG. 3, according to the invention an anti-wear or anti-fretting coating may be applied to bolted joint 112 as a coating 116 on attachment lip 110, or as coating 118 on rotor hub 102. According to the invention, coatings 116, 118 may be anti-wear or anti-fretting coatings that include chromium nitride, titanium nitride, diamond-like carbon, tungsten carbide, tungsten carbon-carbon (WC/C), TiCN, TiAlN, AlTiN, and ZrN, as examples. Further, although a number of examples are provided, it is contemplated that the invention is not to be so limited. According to the invention, coatings 116, 118 may include any material for a coating that reduces fretting, wear of components, and ultimately particulate generation for rotating components in a vacuum, such as in an x-ray tube, that have counterfaces pressed or otherwise maintained against each other. In one example coatings 116, 118 include materials having a hardness of 1750 measured on the Vickers HV scale.

Coatings 116, 118 reduce wear and fretting via one or more processes. First, the coating is harder than the base material to which it is adhered, so its wear rate (adhesive and abrasive wear rate) is lower than the base material. Secondly, in a vacuum its coefficient of friction can be lower than the base material system thereby lower friction wear action. Also, the metallurgical affinity between the counterface materials is much less by using dissimilar materials. These factors all combine to reduce the rate of particulate production in high temperature and high vacuum environments, such as experienced in an x-ray tube, of up to approximately 600° C. in a vacuum of 1E-6 torr. Thus, particulate generation can be reduced by using preferably different coatings on each mating surface (e.g., CrN-WC). In another example coatings 116, 118 are applied having a thickness of approximately 0.5-5 microns (although coatings such as coatings 116, 118 for this and other embodiments are shown having thicknesses that appear to be much greater than 0.5-5 microns for illustrative purposes). Further, it is contemplated that any coating thickness may be applied for coatings 116, 118 and other coatings described herein, and that the invention is not limited to coating thicknesses of 0.5-5 microns, but may have greater or lesser thicknesses than 0.5-5 microns.

As such, embodiments of the invention include a first material pressed against a second material, and the opposing materials are preferably of different materials. Thus, because of the different materials, friction between the two is minimized and there is a reduced amount of adhesive wear because an amount of diffusion bonding between the materials is reduced, as compared to an interface of two of the same materials pressed against each other.

As stated, FIG. 3 illustrates rotor/bearing attachment assembly 100 that includes rotor 62 illustrated as attached to rotor hub 102, itself attached to center shaft 68. That illustrated in FIG. 3 corresponds to what is typically referred to in the art as an inner rotation bearing. That is, centershaft 68 rotates about centerline 66, and stationary components (not shown in FIG. 3) are positioned radially beyond surface 120 of centershaft 68. Stationary components may include but are not limited to outer bearing races 82 and 84 for a roller bearing, or may include an outer bearing component of a spiral groove bearing (SGB).

However, according to the invention the rotor/bearing attachment assembly 100 may be formed using other known techniques. For instance, FIG. 4 illustrates a bolted joint 112 that may also include an interference fit, for additional joint stability, similar to that illustrated in FIG. 3. In yet another embodiment of the invention, illustrated in FIG. 5, rotor/bearing attachment assembly 100 may be components of an outer rotation bearing, as will be further illustrated.

Referring now to FIG. 4, parts are essentially locked together and rotate together during operation. As known in the art, the interference fit may be formed by, for instance, inserting rotor hub 102 into an interference-fit region 122 such that rotor hub 102 is pressed radially into attachment lip 110 as well as axially via a bolted joint 112. Typically, interference-fit region 122 is formed using a lever to force the components together (i.e., a press-fit). According to one embodiment of the invention, an interference fit may be employed as a locating technique to improve and maintain balance over a bolted joint 112. In another example, interference-fit region 122 may be formed by heating attachment lip 110 to excess temperature such that an interference-fit radius 124 of attachment lip 110 expands to be greater than a corresponding radius of bolted joint 112. That is, attachment lip 110 may be heated to excess temperature above, for instance, 300° C. or more, such that rotor hub 102 may fit therein without interference during assembly. As components cool, attachment lip 110 contracts and forms an interference fit with rotor hub 102. In one example a contact axial length 126 may be increased such that an amount of contact area is sufficient to maintain component integrity and provide additional interference fit friction during operation. Thus, one skilled in the art will recognize that using appropriate and known techniques, contact axial length 126 may be formed such that sufficient interference is maintained during operation when both rotor hub 102 and attachment lip 110 are at operating temperatures.

Referring still to FIG. 4, a bolted joint 112 formed axially may be used in conjunction with interference-fit region 122 to attach rotor 62 to rotor hub 102. According to the invention an attachment lip face coating 128 may be applied to attachment lip 110, or a rotor hub face coating 130 may be applied to rotor hub 102. In such fashion, when attachment lip 110 is attached to rotor hub 102 via bolts through centerline 114, a coatings 128 or 130 is applied as illustrated at one or the other location reduces an amount of fretting and particulate generation by having a low coefficient of friction therebetween, and materials that are not chemically compatible so as to avoid diffusion bonding. Further, interference-fit region 122 may also have additional coatings applied along radial faces as a rotor hub outer diameter coating 132 or as an attachment lip inner diameter coating 134.

Further, embodiments of the invention include having coatings applied to each part such that a first coating is pressed against a second coating that is different from the first coating. For instance, in one embodiment attachment lip inner diameter coating 134 may be applied to attachment lip 110 and rotor hub outer diameter coating 132 may be applied to rotor hub 102 such that attachment lip inner diameter coating 134 is pressed against rotor hub outer diameter coating 132 when the interference fit is formed. In this embodiment, coatings 134 and 132 are preferably of different materials.

In fact, any of the four coatings 128-134 may be formed from any of the material types outlined above and in a preferred embodiment coatings 128-134 are selected such from any of the materials described (or having no material applied at all) such that material faces compress having dissimilar materials against one another.

Referring now to FIG. 5, an outer rotation bearing 136 is illustrated. In this embodiment rotor 62 is attached in a face—face bolted joint similar in fashion to that described with respect to FIG. 3. However, it is contemplated that this embodiment, as well, could include an interference fit similar to that illustrated in FIG. 4. Further and as stated, outer rotation bearing 136 may be a roller bearing or a spiral groove bearing (SGB), as examples.

Outer rotation bearing 136 includes a center stationary shaft 138 having a rotor hub or thrust hub 140 attached to an outer rotation bearing 142. Attachment lip 110 is attached to rotor 62 and a bolted joint is formed along centerline 114. Thrust restrictor 144 is attached to center stationary shaft 138 and restrains rotor 62 and other components from axially shifting during operation. Outer rotation bearing 136 may include, for instance, gallium or other liquid metal in a gap 146 in a spiral groove bearing (SGB) embodiment. Or, roller bearings may instead be included between outer rotation bearing 142 and center stationary shaft 138 to form a roller bearing, as previously described.

According to this embodiment, coatings may be applied to components at the interface between attachment lip 110 and thrust hub 140. Coating 148 is included on attachment lip 110 and/or coating 150 is included on thrust hub 140 such that dissimilar materials are used for form bolted joint 112. As such and as described with respect to the FIGS. above, coatings 148 and 150 may be applied to one or both locations in order to reduce fretting and wear.

Thus, according to the embodiments illustrated, a rotor may be attached to a rotor hub or thrust hub by using interference fits, bolted joints, or combinations thereof. In locations where contact points or surfaces are formed, anti-wear or anti-fretting coatings may be applied to one contact surface, the other contact surface, or both. As such, embodiments of the invention include a first material pressed against a second material, and the opposing materials are preferably of different materials. Thus, because of the different materials, friction therebetween the two is minimized and there is a reduced amount of adhesive wear because an amount of diffusion bonding between the materials is reduced, as compared to two of the same materials pressed against each other.

Further, although the embodiments described are for an x-ray tube application and for a joint attaching an x-ray tube target to a bearing hub, it is to be understood that the invention is not to be so limited, and it is contemplated that the invention may be applicable to any rotating components where fretting may occur, causing particulate generation.

Figure 6:
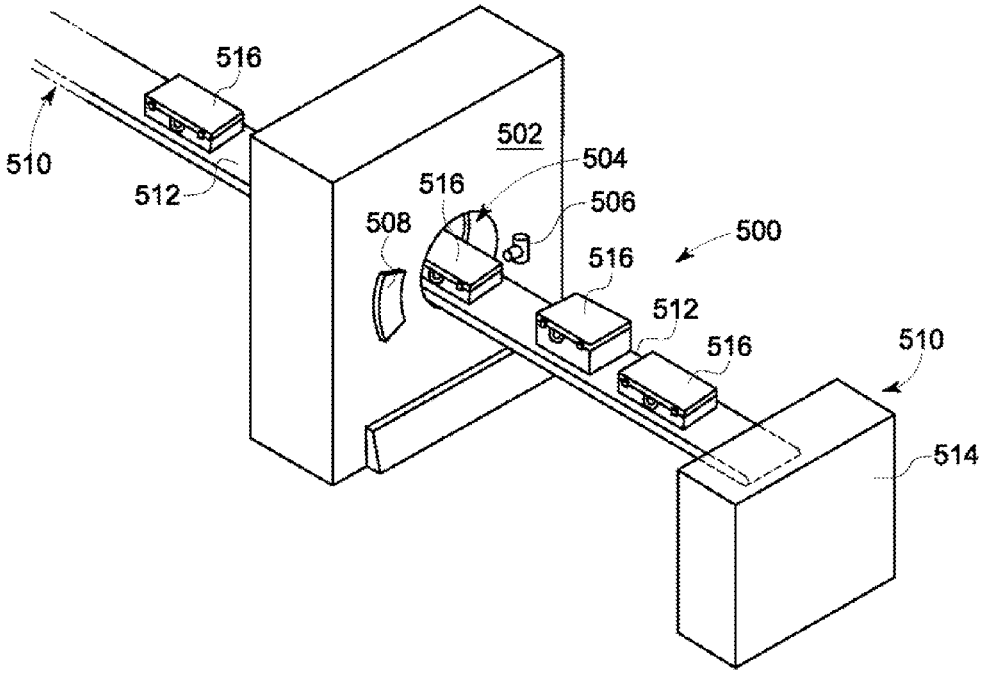
FIG. 6 is a pictorial view of a CT system for use with a non-invasive package inspection system.

FIG. 6 is a pictorial view of an x-ray system 500 for use with a non-invasive package inspection system. The x-ray system 500 includes a gantry 502 having an opening 504 therein through which packages or pieces of baggage may pass. The gantry 502 houses a high frequency electromagnetic energy source, such as an x-ray tube 506, and a detector assembly 508. A conveyor system 510 is also provided and includes a conveyor belt 512 supported by structure 514 to automatically and continuously pass packages or baggage pieces 516 through opening 504 to be scanned. Packages or baggage pieces 516 are fed through opening 504 by conveyor belt 512, imaging data is then acquired, and the conveyor belt 512 removes the packages or baggage pieces 516 from opening 504 in a controlled and continuous manner. As a result, postal inspectors, baggage handlers, and other security personnel may non-invasively inspect the contents of packages or baggage pieces 516 for explosives, knives, guns, contraband, etc. One skilled in the art will recognize that gantry 502 may be stationary or rotatable. In the case of a rotatable gantry 502, x-ray system 500 may be configured to operate as a CT system for baggage scanning or other industrial or medical applications.

According to an embodiment of the invention, an x-ray source or tube 50 includes a cathode 60 adapted to emit electrons, a bearing assembly 58 comprising a rotatable center shaft 68 having a rotor hub 102, a anode or target assembly 56 attached to the rotatable center shaft 68 and positioned to receive the emitted electrons in order to generate x-rays 14 therefrom, a rotor 62 attached to the rotor hub 102 at an attachment face, wherein the attachment face comprises a first material compressed against a second material, and a first anti-wear coating attached to one of the first material and the second material and positioned between the first material and the second material.

According to another embodiment of the invention, a method of fabricating an anode or target assembly 56 for an x-ray source or tube 50 includes applying a first anti-wear coating to one of a first material and a second material, and attaching a rotor 62 to a rotatable center shaft 68 at an interface that is comprised of the first material and the second material, wherein the rotor 62 comprises the first material and the rotatable center shaft 68 comprises the second material.

Yet another embodiment of the invention includes an x-ray imaging system 10 that includes a gantry, a detector 18 attached to the gantry, and an x-ray source or tube 50 attached to the gantry, the x-ray source or tube 50 includes a bearing assembly 58 having a rotatable center shaft 68 and a rotor hub 102 attached thereto, an x-ray target 90 attached to a second end 72 of the rotatable center shaft 68, a rotor 62 attached to a first end 70 of the rotatable center shaft 68 at a contact location, and a first anti-fretting coating, wherein the contact location comprises a first material attached to a second material, and wherein the first anti-fretting coating is attached to one of the first material and the second material at the contact location and is positioned between the first material and the second material.

The invention has been described in terms of the preferred embodiment, and it is recognized that equivalents, alternatives, and modifications, aside from those expressly stated, are possible and within the scope of the appending claims.

What is claimed is:

1. An x-ray tube comprising:
- a cathode adapted to emit electrons;
- a bearing assembly comprising a rotatable shaft having a rotor hub;
- a target assembly attached to the rotatable shaft and positioned to receive the emitted electrons in order to generate x-rays therefrom;
- a rotor attached to the rotor hub at an attachment face, wherein the attachment face comprises a first material compressed against a second material; and
- a first anti-wear coating attached to one of the first material and the second material and positioned between the first material and the second material.

2. The x-ray tube of claim 1 wherein the first anti-wear coating is titanium nitride.

3. The x-ray tube of claim 1 wherein the first anti-wear coating is one of chromium nitride, titanium dioxide, aluminum oxide, diamond-like carbon, tungsten carbide, WC/C, TiCN, TiAlN, AlTiN, and ZrN.

4. The x-ray tube of claim 1 wherein the rotor is attached to the rotor hub via at least one of a bolted joint and an interference fit joint.

5. The x-ray tube of claim 1 wherein the rotor hub is attached to a rotatable shaft of the bearing assembly via one of a weld joint and a bolted joint.

6. The x-ray tube of claim 5 wherein the rotatable shaft is a rotatable shaft of an inner rotation bearing.

7. The x-ray tube of claim 5 wherein the rotatable shaft is a rotatable shaft of an outer rotation bearing.

8. The x-ray tube of claim 1 comprising a second anti-wear coating, different from the first anti-wear coating, positioned on the other of the first material and the second material.

9. The x-ray tube of claim 8 wherein the second anti-wear coating is one of chromium nitride, titanium dioxide, aluminum oxide, diamond-like carbon, tungsten carbide, WC/C, TiCN, TiAlN, AlTiN, and ZrN.

10. A method of fabricating an anode assembly for an x-ray tube comprising:
- applying a first anti-wear coating to one of a first material and a second material; and
- attaching a rotor to a rotor hub that is affixed to a rotatable bearing shaft, the rotor being attached to the rotor hub at an interface that is comprised of the first material and the second material, wherein the rotor comprises the first material and the rotor hub comprises the second material.

11. The method of claim 10 wherein the rotor hub is attached to the rotatable bearing shaft via one of a bolted joint and a shrink fit joint.

12. The method of claim 10 comprising applying a second anti-wear coating to the other of the first material and the second material.

13. The method of claim 12 wherein the second anti-wear coating is different from the first anti-wear coating.

14. The method of claim 10 wherein applying the first anti-wear coating comprises applying one of chromium nitride, titanium dioxide, aluminum oxide, diamond-like carbon, tungsten carbide, WC/C, TiCN, TiAlN, AlTiN, and ZrN.

15. An x-ray imaging system comprising:
- a gantry;
- a detector attached to the gantry; and
- an x-ray tube attached to the gantry, the x-ray tube comprising:
  - a bearing assembly having a bearing hub, a rotatable bearing shaft and a rotor hub attached to the rotatable bearing shaft;
  - an x-ray target attached to the rotatable bearing shaft by way of the bearing hub;
  - a rotor attached to the rotatable bearing shaft by way of the rotor hub, the rotor being joined to the rotor hub at a contact location; and
  - a first anti-fretting coating;
  - wherein the contact location comprises a first material attached to a second material, and wherein the first anti-fretting coating is attached to one of the first material and the second material at the contact location and is positioned between the first material and the second material.

16. The x-ray imaging system of claim 15 wherein the first anti-fretting coating is one of chromium nitride, titanium nitride, diamond-like carbon, and tungsten carbide, WC/C, TiCN, TiAlN, AlTiN, and ZrN.

17. The x-ray imaging system of claim 15 wherein the rotor is attached directly to the rotor hub at the contact location, and wherein the rotor is the first material and the rotor hub is the second material.

18. The x-ray imaging system of claim 15 comprising a second anti-fretting coating attached to the other of the first material and the second material, wherein the second anti-fretting material is a material that is different from the first anti-fretting material.

19. The x-ray imaging system of claim 18 wherein the first anti-fretting coating and the second anti-fretting coating are comprised of one of chromium nitride, titanium nitride, diamond-like carbon, tungsten carbide, WC/C, TiCN, TiAlN, AlTiN, and ZrN.

* * * * *